US011349193B2

(12) United States Patent
Ramasamy et al.

(10) Patent No.: US 11,349,193 B2
(45) Date of Patent: May 31, 2022

(54) SYSTEM AND METHOD FOR A HINGE CAVITY ELECTRIC FIELD TRAP USING HEAT EXHAUST VENT GRILL

(71) Applicant: Dell Products, LP, Round Rock, TX (US)

(72) Inventors: Suresh K. Ramasamy, Cedar Park, TX (US); Sumana Pallampati, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 160 days.

(21) Appl. No.: 16/704,836

(22) Filed: Dec. 5, 2019

(65) Prior Publication Data

US 2021/0175606 A1 Jun. 10, 2021

(51) Int. Cl.
*H01Q 1/22* (2006.01)
*H01Q 5/371* (2015.01)

(52) U.S. Cl.
CPC ..... *H01Q 1/2266* (2013.01); *H01Q 5/371* (2015.01)

(58) Field of Classification Search
CPC ..... H01Q 1/2266; H01Q 5/371; H01Q 9/30; H01Q 1/2291; H01Q 1/52; H01Q 5/378
See application file for complete search history.

(56) References Cited

U.S. PATENT DOCUMENTS

2006/0284839 A1* 12/2006 Breed ..... B62D 1/046 345/156
2010/0245178 A1* 9/2010 Hsieh ..... H01Q 1/243 343/702
2018/0006354 A1* 1/2018 Nivet ..... H01Q 1/2266
2019/0356051 A1* 11/2019 Barrera ..... H01Q 1/2266

* cited by examiner

*Primary Examiner* — Hai V Tran
*Assistant Examiner* — Michael M Bouizza
(74) *Attorney, Agent, or Firm* — Prol Intellectual Property Law, PLLC; H. Kenneth Prol

(57) ABSTRACT

An information handling system to wirelessly transmit and receive data at an antenna includes a base metal chassis containing components of the information handling system, the base housing metal chassis including a C-cover and D-cover housing the components; a display chassis including an A-cover operatively coupled to the base metal chassis via a hinge; a vent cavity at an edge of the D-cover; a metal exhaust grill formed within the base metal chassis; an antenna element co-located within the vent cavity; and a ground current path forming an electric field trap via the metal exhaust grill to the D-cover of the base metal chassis in the thermal exhaust vent cavity to limit currents from resonating metal structures external to the vent cavity of the information handling system; and an antenna aperture to direct resonance with the antenna element out of the vent cavity.

20 Claims, 9 Drawing Sheets

SYSTEM AND METHOD FOR A HINGE CAVITY ELECTRIC FIELD TRAP USING HEAT EXHAUST VENT GRILL

FIELD OF THE DISCLOSURE

The present disclosure generally relates to information handling systems, and more particularly relates to an information handling system including an antenna within an antenna chamber with the antenna chamber having a first and second aperture formed within the chassis of the information handling system.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, read-only memory (ROM), and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components. The information handling system may also include telecommunication, network communication, and video communication capabilities. The information handling system may also include one or more buses operable to transmit communications between the various hardware components. The information handling system may also include telecommunication, network communication, and video communication capabilities. Information handling system chassis parts may include case portions such as for a laptop information handling system including the C-cover over components designed with a metal structure. The information handling system may be configurable with an antenna formed within the C-cover and D-cover assembly close to a metal heat exhaust grill.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings may indicate similar or identical items.

DETAILED DESCRIPTION OF THE DRAWINGS

Figure 1:
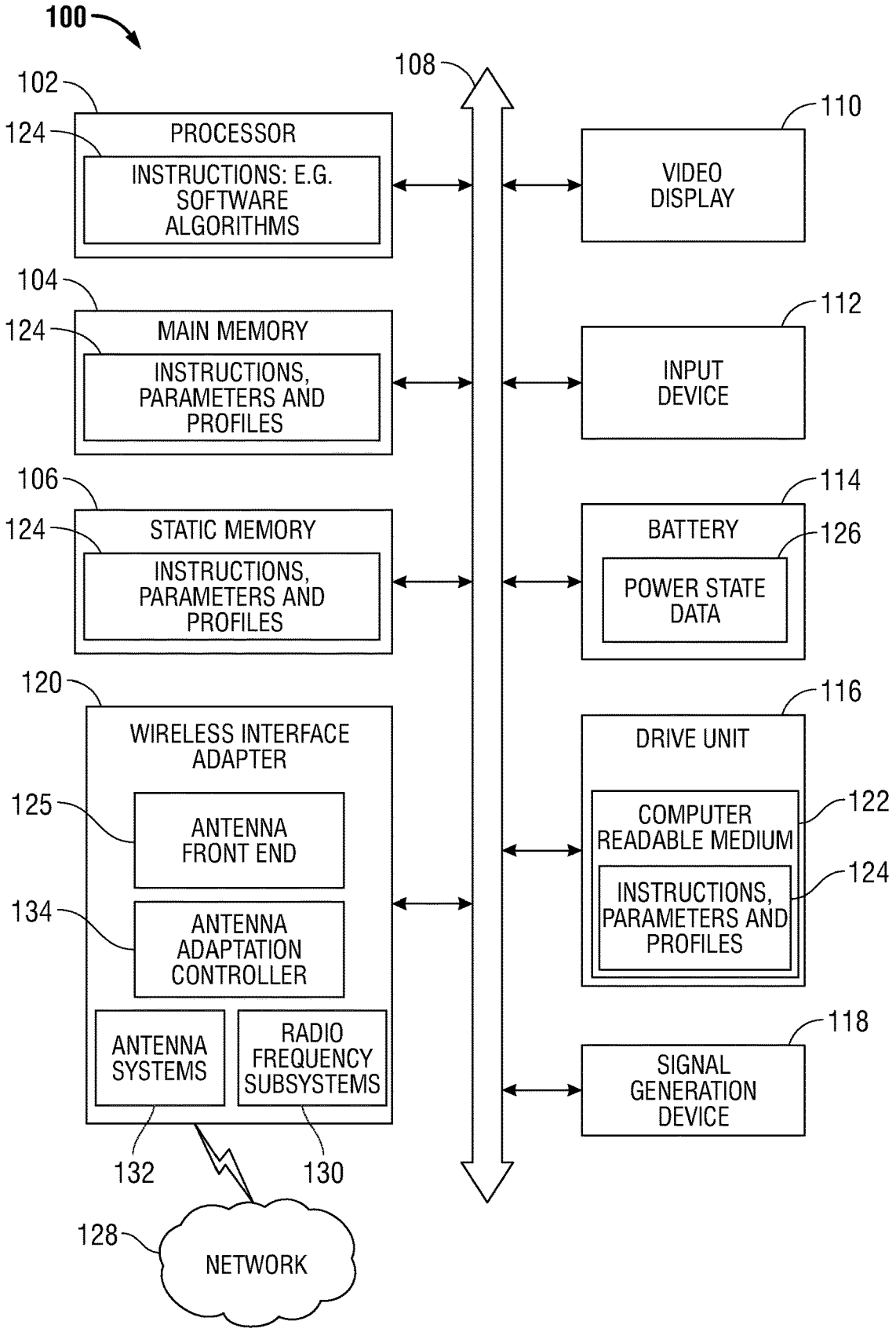
FIG. 1 illustrates an embodiment of information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

For aesthetic, strength, and performance reasons, information handling system chassis parts are more commonly designed with a metal structure. In an embodiment, a laptop information handling system, for example, may include a plurality of covers for the interior components of the information handling system forming a base housing and a display housing. In these embodiments, a form factor case may include an "A-cover" which serves as a back cover for a display housing and a "B-cover" which may serve as the bezel, if any, and a display screen of the convertible laptop information handling system in an embodiment. In a further example, the laptop information handling system case may include a "C-cover" housing a keyboard, touchpad, and any cover in which these components are set and a "D-cover" base housing for the convertible information handling system. With the need for utility of lighter, thinner, and more streamlined devices, the use of full metal portions for the outer covers of the display and base housing (e.g. the A-cover and the D-cover) is desirable for strength as well as aesthetic reasons. At the same time, the demands for wireless operation also increase. This includes addition of many simultaneously operating radiofrequency systems, addition of more antennas, and utilization of various antenna types. However, the thinner and more streamlined devices have fewer locations and area available for mounting radiofrequency transmitters on these mobile information handling systems. Additionally, the use of antennas may cause an excitation of the metal surfaces of the covers described herein leading to destructive interference in the signals sent by the antenna. Thus, a streamlined, full metal chassis capable of meeting the increasing wireless operation demands is needed.

Previous information handling systems would address these competing needs by providing for cutout portions of a metal outer chassis cover filled with plastic behind which radiofrequency transmitters/receivers would be mounted. The cutouts to accommodate radio frequency (RF) transmitters/receivers are often located in aesthetically undesirable locations or and required additional plastic components to cover the cutout, thus not fully meeting the streamlining needs. The plastic components added a component to be manufactured and were required to be seamlessly integrated into an otherwise smooth metal chassis cover. Further, the plastic portions included may be more expensive to machine than aluminum alloy metals, and may require intricate multi-step processes for integrating the metal and plastic parts into a single chassis. This requirement could require difficult and expensive processes to manufacture with a less desirable result. Other options included, for aperture type antenna transmitters, creation of an aperture in the metal display panel chassis and using the metal chassis as a ground plane for excitation of the aperture.

In addition, in the case of the laptop information handling system, often an antenna such as an aperture antenna system would be located at a display housing (e.g. A-cover) with a plastic antenna window in a metal chassis cover to radiate in a closed mode, or to radiate in an open mode. Such a configuration could make the display panel housing (e.g. A-cover), or even the base panel housing (e.g. C-cover), thicker to accommodate antennas and cables behind the plastic panel at the top (or bottom) of either housing. Overall, an addition of a plastic antenna window in an A-cover or C-cover may not meet the streamlining needs. A solution is needed that does not increase the thickness of the metal chassis, and does not require additional components and manufacturing steps such as those associated with installation of RF transparent windows. With limited space available in the display housing due to minimal bezel of the B-cover, antenna location is pushed down to and along the hinge or into the base housing.

Embodiments of the present disclosure may decrease the complexity and cost of creating chasses for information handling systems by forming the outer chassis (e.g. the A-cover or the D-cover) entirely of metal and co-locating an antenna with a metal exhaust grill formed within the base metal chassis such as close to a hinge placed between the display housing assembly and the base housing assembly. This placement of the antenna at a location by the metal exhaust grill provides for a relatively more streamlined information handling system while minimizing re-radiation along a hinge gap or an edge of the A-cover of the display housing as described herein. Additionally, the placement of this antenna or an additional antenna by the metal exhaust grill provides for additional space at the B-cover to expand the size of any video display device of the information handling system. Additionally, regardless of the orientation of the information handling system, the antenna reception and transmission strength may remain constant in an upward orientation. Still further, a ground current path associated with the antenna may accommodate for any excitation of metal objects with the metal exhaust grill by trapping any antenna-emitted electromagnetic radiation out from the antenna and exhaust vent to minimize additional noise being created.

The metal chassis in embodiments described herein may include a hinge operably connecting the A-cover to the D-cover such that the keyboard and touchpad enclosed within the C-cover and attached to the D-cover may be placed in an open or closed configuration with respect to the digital display enclosed within the B-cover and attached to the A-cover. The antenna vent, in an embodiment, may be co-located with one or both of a thermal vent or an audio vent so as to provide for the streamlining of the information handling system without compromising the ability of the antenna to transmit and receive data from and to the information handling system.

Manufacture of embodiments of the present disclosure may involve fewer extraneous parts than previous chasses by forming the exterior or outer portions of the information handling system, including the bottom portion of the D-cover and the top portion of the A-cover, entirely from metal. In order to allow for manufacture of fully metallic outer chasses including the A-cover and the D-cover, embodiments of the present disclosure form the full form factor case enclosing the information handling system such that one or more transmitting antennas may be within the antenna vent integrated into the base metal chassis (i.e., D-cover) of the information handling system. This antenna vent may also serve as a thermal vent in an embodiment. In another embodiment, the antenna vent may also serve as an audio vent.

The transmitting antennas of embodiments of the present disclosure may include a planar wire antenna. In embodiments herein, the planar wire antenna in the thermal exhaust vent may be co-located with a metal exhaust grill. The planar wire antenna may be used to transceiver frequencies according to embodiments herein. Frequency bands such as in the 5 GHz range or 2.4 GHz range may be transcieved in some example embodiments. Such a method of placing an antenna at a location of the exhaust vent with a metal exhaust grill of the form factor case may exclude the integration of any RF transparent plastic windows within the exterior of the A-cover or the D-cover, thus decreasing the complexity and cost of manufacture. In an aspect, the metal exhaust grill may serve as an electric field trap for the thermal vent as described in some embodiments herein. In other embodiments, a plastic, water repellant layer, or other RF-transparent window may be located at the antenna location if some type of water resistance is needed for example. The antenna may then effectively transmit communications signal perpendicularly from the surface of the D-cover. When the D-cover and A-cover are placed in the open configuration, the antenna in such an embodiment may transmit the communications signals away from the information handling system and into the nearby environment.

In embodiments described herein, the antenna may lie vertically lower than the keyboard of the C-cover, which is the surface most likely to interface with human body parts. In such embodiments, placement of the transmitting antenna beneath the C-cover and next to or above the metal exhaust grill may place the antenna further away from human body parts than an information handling system placing the transmitting antenna directly beneath, beside, or co-planar with the keyboard.

In an embodiment, the C-cover/D-cover assembly may further include a ground current path formed via the metal exhaust grill from the antenna to the D-cover so as to prevent currents associated with the antenna from traveling to an A-cover of the information handling system operatively coupled to the base metal chassis via the hinge. In an embodiment, the ground current path may create an electromagnetic (EM) field trap using the metal exhaust grill. This may reduce the amount of destructive interference caused by any excitation of the metal surfaces (i.e., A-cover and hinge) during operation of the antenna. Further, with the placement of this EM field trap and ground current path near the hinge, the heat exhaust grill may be used as the antenna aperture cavity with the EM field trap to suppress any excitation of the metal pieces of the hinge and A-cover preventing the cavity within the hinge and along the A-cover from resonating. During operation of the antenna, the metal exhaust grill may be used as a grounding wall for the antenna thereby eliminating the use of a dedicated grounding wall placed behind the antenna and allowing the metal exhaust grill to be used as both the grounding wall and part of the ground current path while allowing for an operating exhaust vent. Examples are set forth below with respect to particular aspects of an information handling system including base and display portions such as for a laptop information handling system including the chassis components designed with a fully metal structure.

FIG. 1 shows an information handling system 100 capable of administering each of the specific embodiments of the present disclosure. The information handling system 100, in an embodiment, can represent the mobile information handling systems 210, 220, and 230 or servers or systems located anywhere within network 200 described in connection with FIG. 2 herein, including the remote data centers operating virtual machine applications. Information handling system 100 may represent a mobile information handling system associated with a user or recipient of intended wireless communication. A mobile information handling system may execute instructions via a processor such as a microcontroller unit (MCU) operating both firmware instructions or hardwired instructions for the antenna adaptation controller 134 to achieve WLAN or WWAN antenna optimization according to embodiments disclosed herein. The application programs operating on the information handling system 100 may communicate or otherwise operate via concurrent wireless links, individual wireless links, or combinations over any available radio access technology (RAT) protocols including WLAN protocols. These application programs may operate in some example embodiments as software, in whole or in part, on an information handling system while other portions of the software applications may operate on remote server systems. The antenna adaptation controller 134 of the presently disclosed embodiments may operate as firmware or hardwired circuitry or any combination on controllers or processors within the information handing system 100 for interface with components of a wireless interface adapter 120. It is understood that some aspects of the antenna adaptation controller 134 described herein may interface or operate as software or via other controllers associated with the wireless interface adapter 120 or elsewhere within information handling system 100. Information handling system 100 may also represent a networked server or other system from which some software applications are administered or which wireless communications such as across WLAN or WWAN may be conducted. In other aspects, networked servers or systems may operate the antenna adaptation controller 134 for use with a wireless interface adapter 120 on those devices similar to embodiments for WLAN or WWAN antenna optimization operation according to according to various embodiments.

The information handling system 100 may include a processor 102 such as a central processing unit (CPU), a graphics processing unit (GPU), or both. Moreover, the information handling system 100 can include a main memory 104 and a static memory 106 that can communicate with each other via a bus 108. As shown, the information handling system 100 may further include a video display unit 110, such as a liquid crystal display (LCD), an organic light emitting diode (OLED), a flat panel display, a solid-state display, or a cathode ray tube (CRT). Display 110 may include a touch screen display module and touch screen controller (not shown) for receiving user inputs to the information handling system 100. Touch screen display module may detect touch or proximity to a display screen by detecting capacitance changes in the display screen. Additionally, the information handling system 100 may include an input device 112, such as a keyboard, and a cursor control device, such as a mouse or touchpad or similar peripheral input device. The information handling system may include a power source such as battery 114 or an A/C power source. The information handling system 100 can also include a disk drive unit 116, and a signal generation device 118, such as a speaker or remote control. The information handling system 100 can include a network interface device such as a wireless adapter 120. The information handling system 100 can also represent a server device whose resources can be shared by multiple client devices, or it can represent an individual client device, such as a desktop personal computer, a laptop computer, a tablet computer, a 360-degree convertible device, a wearable computing device, or a mobile smart phone.

The information handling system 100 can include sets of instructions 124 that can be executed to cause the computer system to perform any one or more desired applications. In many aspects, sets of instructions 124 may implement wireless communications via one or more antenna systems 132 available on information handling system 100. Operation of WLAN and WWAN wireless communications may be enhanced or otherwise improved via WLAN or WWAN antenna operation adjustments via the methods or controller-based functions relating to the antenna adaptation controller 134 disclosed herein. For example, instructions or a controller may execute software or firmware applications or algorithms which utilize one or more wireless links for wireless communications via the wireless interface adapter as well as other aspects or components. The antenna adaptation controller 134 may execute instructions as disclosed herein for monitoring wireless link state information, information handling system configuration data, SAR proximity sensor detection, or other input data to generate channel estimation and determine antenna radiation patterns. In the embodiments presented herein, the antenna adaptation controller 134 may execute instructions as disclosed herein to transmit a communications signal from an antenna 132 located within a vent cavity formed in the base metal chassis to transmit an electromagnetic wave at a determined frequency or harmonics thereof. Antenna system 132 of the disclosed embodiments may prevent noise sourced from within or outside the antenna vent from creating interference with the determined frequency, or harmonics thereof, and reflecting transmission or receiving power for the antenna system via an isolation metal grill within the antenna vent to a grounding parasitic element in the aperture antenna cavity. In some embodiments presented herein, the antenna adaptation controller 134 may also execute instructions as disclosed herein to adjust, via a parasitic coupling element, change the directionality and/or pattern of the emitted RF signals from the antenna. The antenna adaptation controller 134 may implement adjustments to wireless antenna systems and resources via a radio frequency integrated circuit (RFIC) front end 125 and WLAN or WWAN radio module systems within the wireless interface device 120. Aspects of the antenna optimization for the antenna adaptation controller 134 may be included as part of an antenna front end 125 in some aspects or may be included with other aspects of the wireless interface device 120 such as WLAN radio module such as part of the radio frequency (RF) subsystems 130. The antenna adaptation controller 134 described in the present disclosure and operating as firmware or hardware (or in some parts software) may remedy or adjust one or more of a plurality of antenna systems 132 via selecting power adjustments and adjustments to an antenna adaptation network to modify antenna radiation patterns and parasitic coupling element operations. Multiple WLAN or WWAN antenna systems may operate on various communication frequency bands such as under IEEE 802.11a and IEEE 802.11g providing multiple band options for frequency channels. Further antenna radiation patterns and selection of antenna options or power levels may be adapted due physical proximity of other antenna systems, of a user with potential SAR exposure, or improvement of RF channel operation according to received signal strength indicator (RSSI), signal to noise ratio (SNR), bit error rate (BER), modulation and coding scheme index values (MCS), or data throughput indications among other factors. In some aspects WLAN antenna adaptation controller may execute firmware algorithms or hardware to regulate operation of the one or more antenna systems 132 such as WLAN antennas in the information handling system 100 to avoid poor wireless link performance due to poor reception, poor MCS levels of data bandwidth available, or poor indication of throughput due to indications of low RSSI, low power levels available (such as due to SAR), inefficient radiation patterns among other potential effects on wireless link channels used.

Various software modules comprising software application instructions 124 or firmware instructions may be coordinated by an operating system (OS) and via an application programming interface (API). An example operating system may include Windows®, Android®, and other OS types known in the art. Example APIs may include Win 32, Core Java API, Android APIs, or wireless adapter driver API. In a further example, processor 102 may conduct processing of mobile information handling system applications by the information handling system 100 according to the systems and methods disclosed herein which may utilize wireless communications. The computer system 100 may operate as a standalone device or may be connected such as using a network, to other computer systems or peripheral devices. In other aspects, additional processor or control logic may be implemented in graphical processor units (GPUs) or controllers located with radio modules or within a wireless adapter 120 to implement method embodiments of the antenna adaptation controller and antenna optimization according to embodiments herein. Code instructions 124 in firmware, hardware or some combination may be executed to implement operations of the antenna adaptation controller and antenna optimization on control logic or processor systems within the wireless adapter 120 for example.

In a networked deployment, the information handling system 100 may operate in the capacity of a server or as a client user computer in a server-client user network environment, or as a peer computer system in a peer-to-peer (or distributed) network environment. The information handling system 100 can also be implemented as or incorporated into various devices, such as a personal computer (PC), a tablet PC, a set-top box (STB), a PDA, a mobile information handling system, a tablet computer, a laptop computer, a desktop computer, a communications device, a wireless smart phone, wearable computing devices, a land-line telephone, a control system, a camera, a scanner, a printer, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single information handling system 100 is illustrated, the term "system" shall also be taken to include any collection of systems or sub-systems that individually or jointly execute a set, or multiple sets, of instructions to perform one or more computer functions.

The disk drive unit 116 may include a computer-readable medium 122 in which one or more sets of instructions 124 such as software can be embedded. Similarly, main memory 104 and static memory 106 may also contain computer-readable medium for storage of one or more sets of instructions, parameters, or profiles 124. The disk drive unit 116 and static memory 106 also contains space for data storage. Some memory or storage may reside in the wireless adapter 120. Further, the instructions 124 that embody one or more of the methods or logic as described herein. For example, instructions relating to the WLAN antenna adaptation system or antenna adjustments described in embodiments herein may be stored here or transmitted to local memory located with the antenna adaptation controller 134, antenna front end 125, or wireless module in radiofrequency subsystem 130 in the wireless interface adapter 120.

In a particular embodiment, the instructions, parameters, and profiles 124 may reside completely, or at least partially, within a memory, such as non-volatile static memory, during execution of antenna adaptation by the antenna adaptation controller 134 in wireless interface adapter 132 of information handling system 100. As explained, some or all of the WLAN antenna adaptation and antenna optimization may be executed locally at the antenna adaptation controller 134, RF front end 125, or wireless module subsystem 130. Some aspects may operate remotely among those portions of the wireless interface adapter or with the main memory 104 and the processor 102 in parts including the computer-readable media in some embodiments.

Battery 114 may be operatively coupled to a power management unit that tracks and provides power stat data 126. This power state data 126 may be stored with the instructions, parameters, and profiles 124 to be used with the systems and methods disclosed herein in determining WLAN antenna adaptation and antenna optimization in some embodiments.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. Wireless adapter 120 may include one or more RF subsystems 130 with transmitter/receiver circuitry, modem circuitry, one or more unified antenna front end circuits 125, one or more wireless controller circuits such as antenna adaptation controller 134, amplifiers, antenna systems 132 and other radio frequency (RF) subsystem circuitry 130 for wireless communications via multiple radio access technologies. Each radiofrequency subsystem 130 may communicate with one or more wireless technology protocols. The radiofrequency subsystem 130 may contain individual subscriber identity module (SIM) profiles for each technology service provider and their available protocols for subscriber-based radio access technologies such as cellular LTE communications. The wireless adapter 120 may also include antenna systems 132 which may be tunable antenna systems or may include an antenna adaptation network for use with the system and methods disclosed herein to optimize antenna system operation. Additional antenna system adaptation network circuitry (not shown) may also be included with the wireless interface adapter 120 to implement WLAN or WWAN modification measures as described in various embodiments of the present disclosure.

In some aspects of the present disclosure, a wireless adapter 120 may operate two or more wireless links. In a further aspect, the wireless adapter 120 may operate the two or more wireless links with a single, shared communication frequency band such as with the Wi-Fi WLAN operation or 5G LTE standard WWAN operations in an example aspect. For example, a 5 GHz wireless communication frequency band may be apportioned under the 5G standards for communication on either small cell WWAN wireless link operation or Wi-Fi WLAN operation as well as other wireless activity in LTE, WiFi, WiGig, Bluetooth, or other communication protocols. In some embodiments, the shared, wireless communication bands may be transmitted through one or a plurality of antennas. Other communication frequency bands are contemplated for use with the embodiments of the present disclosure as well.

In other aspects, the information handling system 100 operating as a mobile information handling system may operate a plurality of wireless adapters 120 for concurrent radio operation in one or more wireless communication bands. The plurality of wireless adapters 120 may further a wireless communication bands or operate in nearby wireless communication bands in some disclosed embodiments. Further, harmonics, environmental wireless conditions, and other effects may impact wireless link operation when a plurality of wireless links are operating as in some of the presently described embodiments. The series of potential effects on wireless link operation may cause an assessment of the wireless adapters 120 to potentially make antenna system adjustments according to the WLAN antenna adaptation control system of the present disclosure. Further, embodiments of antenna systems 132 described herein may co-locate the antenna system 132 in a thermal vent near a hinge gap between an A-cover and a D-cover of an information handling system. Embodiments herein describe a system design to minimize the impact of multiple wireless links operating concurrently in such systems.

The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. Wireless adapter 120 and antenna adaptation controller 134 may connect to any combination of macro-cellular wireless connections including 2G, 2.5G, 3G, 4G, 5G or the like from one or more service providers. Utilization of radiofrequency communication bands according to several example embodiments of the present disclosure may include bands used with the WLAN standards and WWAN carriers which may operate in both licensed and unlicensed spectrums. For example, both WLAN and WWAN may use the Unlicensed National Information Infrastructure (U-NII) band which typically operates in the ~5 MHz frequency band such as 802.11 a/h/j/n/ac (e.g., center frequencies between 5.170-5.785 GHz). It is understood that any number of available channels may be available under the 5 GHz shared communication frequency band in example embodiments. WLAN, for example, may also operate at a 2.4 GHz band. WWAN may operate in a number of bands, some of which are propriety but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. In the example embodiment, mobile information handling system 100 includes both unlicensed wireless RF communication capabilities as well as licensed wireless RF communication capabilities. For example, licensed wireless RF communication capabilities may be available via a subscriber carrier wireless service. With the licensed wireless RF communication capability, WWAN RF front end may operate on a licensed WWAN wireless radio with authorization for subscriber access to a wireless service provider on a carrier licensed frequency band.

The wireless adapter 120 can represent an add-in card, wireless network interface module that is integrated with a main board of the information handling system or integrated with another wireless network interface capability, or any combination thereof. In an embodiment the wireless adapter 120 may include one or more RF subsystems 130 including transmitters and wireless controllers such as wireless module subsystems for connecting via a multitude of wireless links under a variety of protocols. In an example embodiment, an information handling system may have an antenna system transmitter 132 for 5G small cell WWAN, Wi-Fi WLAN or WiGig connectivity and one or more additional antenna system transmitters 132 for macro-cellular communication. The RF subsystems 130 include wireless controllers to manage authentication, connectivity, communications, power levels for transmission, buffering, error correction, baseband processing, and other functions of the wireless adapter 120.

The RF subsystems 130 of the wireless adapters may also measure various metrics relating to wireless communication pursuant to operation of an antenna system as in the present disclosure. For example, the wireless controller of a RF subsystem 130 may manage detecting and measuring received signal strength levels, bit error rates, signal to noise ratios, latencies, power delay profile, delay spread, and other metrics relating to signal quality and strength. Such detected and measured aspects of wireless links, such as WLAN links operating on one or more antenna systems 132, may be used by the antenna adaptation controller to adapt the antenna systems 132 according to an antenna adaptation network according to various embodiments herein. In one embodiment, a wireless controller of a wireless interface adapter 120 may manage one or more RF subsystems 130. The wireless controller also manages transmission power levels which directly affect RF subsystem power consumption as well as transmission power levels from the plurality of antenna systems 132. The transmission power levels from the antenna systems 132 may be relevant to specific absorption rate (SAR) safety limitations for transmitting mobile information handling systems. To control and measure power consumption via a RF subsystem 130, the RF subsystem 130 may control and measure current and voltage power that is directed to operate one or more antenna systems 132.

The wireless network may have a wireless mesh architecture in accordance with mesh networks described by the wireless data communications standards or similar standards in some embodiments but not necessarily in all embodiments. The wireless adapter 120 may also connect to the external network via a WPAN, WLAN, WWAN or similar wireless switched Ethernet connection. The wireless data communication standards set forth protocols for communications and routing via access points, as well as protocols for a variety of other operations. Other operations may include handoff of client devices moving between nodes, self-organizing of routing operations, or self-healing architectures in case of interruption.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionalities as described herein.

The present disclosure contemplates a computer-readable medium that includes instructions, parameters, and profiles 124 or receives and executes instructions, parameters, and profiles 124 responsive to a propagated signal; so that a device connected to a network 128 can communicate voice, video or data over the network 128. Further, the instructions 124 may be transmitted or received over the network 128 via the network interface device or wireless adapter 120.

Information handling system 100 includes one or more application programs 124, and Basic Input/Output System and firmware (BIOS/FW) code 124. BIOS/FW code 124 functions to initialize information handling system 100 on power up, to launch an operating system, and to manage input and output interactions between the operating system and the other elements of information handling system 100. In a particular embodiment, BIOS/FW code 124 reside in memory 104, and include machine-executable code that is executed by processor 102 to perform various functions of information handling system 100. In another embodiment (not illustrated), application programs and BIOS/FW code reside in another storage medium of information handling system 100. For example, application programs and BIOS/FW code can reside in drive 116, in a ROM (not illustrated) associated with information handling system 100, in an option-ROM (not illustrated) associated with various devices of information handling system 100, in storage system 107, in a storage system (not illustrated) associated with network channel of a wireless adapter 120, in another storage medium of information handling system 100, or a combination thereof. Application programs 124 and BIOS/FW code 124 can each be implemented as single programs, or as separate programs carrying out the various features as described herein.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Figure 2:
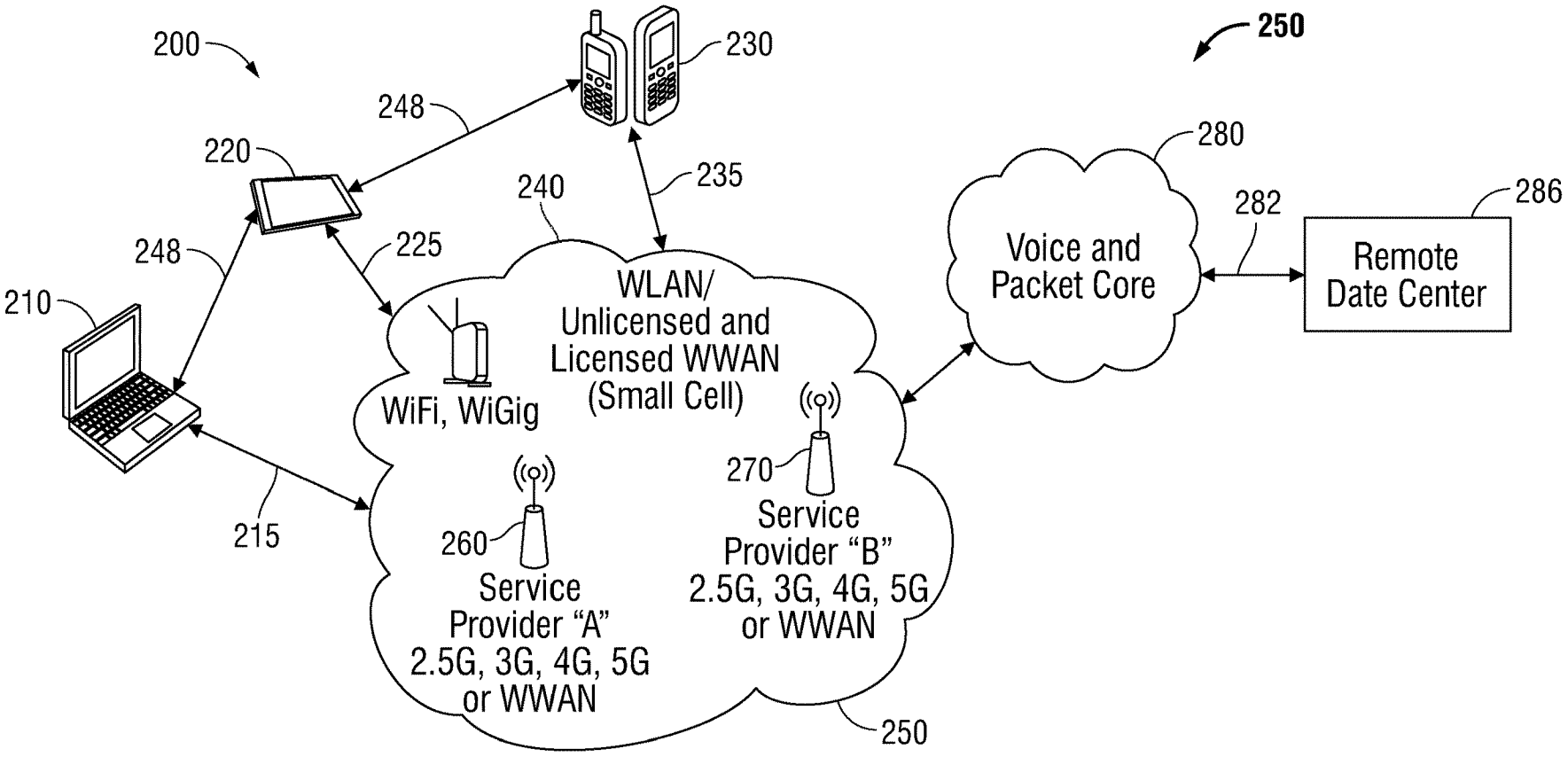
FIG. 2 is a block diagram of a network environment offering several communication protocol options and mobile information handling systems according to an embodiment of the present disclosure.

FIG. 2 illustrates a network 200 that can include one or more information handling systems 210, 220, 230. In a particular embodiment, network 200 includes networked mobile information handling systems 210, 220, and 230, wireless network access points, and multiple wireless connection link options. A variety of additional computing resources of network 200 may include client mobile information handling systems, data processing servers, network storage devices, local and wide area networks, or other resources as needed or desired. As partially depicted, systems 210, 220, and 230 may be a laptop computer, tablet computer, 360-degree convertible systems, wearable computing devices, or a smart phone device. These mobile information handling systems 210, 220, and 230, may access a wireless local network 240, or they may access a macro-cellular network 250. For example, the wireless local network 240 may be the wireless local area network (WLAN), a wireless personal area network (WPAN), or a wireless wide area network (WWAN). In an example embodiment, LTE-LAA WWAN may operate with a small-cell WWAN wireless access point option.

Since WPAN or Wi-Fi Direct Connection 248 and WWAN networks can functionally operate similar to WLANs, they may be considered as wireless local area networks (WLANs) for purposes herein. Components of a WLAN may be connected by wireline or Ethernet connections to a wider external network. For example, wireless network access points may be connected to a wireless network controller and an Ethernet switch. Wireless communications across wireless local network 240 may be via standard protocols such as IEEE 802.11 Wi-Fi, IEEE 802.11ad WiGig, IEEE 802.15 WPAN, or emerging 5G small cell WWAN communications such as eNodeB, IEEE 802.11, IEEE 1914/1904, IEEE P2413/1471/42010, or similar wireless network protocols developed for 5G communications. Alternatively, other available wireless links within network 200 may include macro-cellular connections 250 via one or more service providers 260 and 270. Service provider macro-cellular connections may include 2G standards such as GSM, 2.5G standards such as GSM EDGE and GPRS, 3G standards such as W-CDMA/UMTS and CDMA 2000, 4G standards, or emerging 5G standards including WiMAX, LTE, and LTE Advanced, LTE-LAA, small cell WWAN, and the like.

Wireless local network 240 and macro-cellular network 250 may include a variety of licensed, unlicensed or shared communication frequency bands as well as a variety of wireless protocol technologies ranging from those operating in macrocells, small cells, picocells, or femtocells.

In some embodiments according to the present disclosure, a networked mobile information handling system 210, 220, or 230 may have a plurality of wireless network interface systems capable of transmitting simultaneously within a shared communication frequency band. That communication within a shared communication frequency band may be sourced from different protocols on parallel wireless network interface systems or from a single wireless network interface system capable of transmitting and receiving from multiple protocols. Similarly, a single antenna or plural antennas may be used on each of the wireless communication devices. Example competing protocols may be local wireless network access protocols such as Wi-Fi/WLAN, WiGig, and small cell WWAN in an unlicensed, shared communication frequency band. Example communication frequency bands may include unlicensed 5 GHz frequency bands or 3.5 GHz conditional shared communication frequency bands under FCC Part 96. Wi-Fi ISM frequency bands that could be subject to sharing include 2.4 GHz, 60 GHz, 900 MHz or similar bands as understood by those of skill in the art. Within local portion of wireless network 250 access points for Wi-Fi or WiGig as well as small cell WWAN connectivity may be available in emerging 5G technology. This may create situations where a plurality of antenna systems are operating on a mobile information handling system 210, 220 or 230 via concurrent communication wireless links on both WLAN and WWAN and which may operate within the same, adjacent, or otherwise interfering communication frequency bands. The antenna may be a transmitting antenna that includes high-band, medium-band, low-band, and unlicensed band transmitting antennas. Alternatively, embodiments may include a single transceiving antennas capable of receiving and transmitting, and/or more than one transceiving antennas. Each of the antennas included in the information handling system 100 in an embodiment may be subject to the FCC regulations on specific absorption rate (SAR). The antenna in the embodiments described herein is an aperture antenna intended for efficient use of space within a metal chassis of an information handling system. Aperture antennas in embodiments of the present disclosure may be an effective improvement on wireless antennas employed in previous information handling systems.

The voice and packet core network 280 may contain externally accessible computing resources and connect to a remote data center 286. The voice and packet core network 280 may contain multiple intermediate web servers or other locations with accessible data (not shown). The voice and packet core network 280 may also connect to other wireless networks similar to 240 or 250 and additional mobile information handling systems such as 210, 220, 230 or similar connected to those additional wireless networks. Connection 282 between the wireless network 240 and remote data center 286 or connection to other additional wireless networks may be via Ethernet or another similar connection to the world-wide-web, a WAN, a LAN, another WLAN, or other network structure. Such a connection 282 may be made via a WLAN access point/Ethernet switch to the external network and be a backhaul connection. The access point may be connected to one or more wireless access points in the WLAN before connecting directly to a mobile information handling system or may connect directly to one or more mobile information handling systems 210, 220, and 230. Alternatively, mobile information handling systems 210, 220, and 230 may connect to the external network via base station locations at service providers such as 260 and 270. These service provider locations may be network connected via backhaul connectivity through the voice and packet core network 280.

Remote data centers may include web servers or resources within a cloud environment that operate via the voice and packet core 280 or other wider internet connectivity. For example, remote data centers can include additional information handling systems, data processing servers, network storage devices, local and wide area networks, or other resources as needed or desired. Having such remote capabilities may permit fewer resources to be maintained at the mobile information handling systems 210, 220, and 230 allowing streamlining and efficiency within those devices. Similarly, remote data center permits fewer resources to be maintained in other parts of network 200.

Although 215, 225, and 235 are shown connecting wireless adapters of mobile information handling systems 210, 220, and 230 to wireless networks 240 or 250, a variety of wireless links are contemplated. Wireless communication may link through a wireless access point (Wi-Fi or WiGig), through unlicensed WWAN small cell base stations such as in network 240 or through a service provider tower such as that shown with service provider A 260 or service provider B 270 and in network 250. In other aspects, mobile information handling systems 210, 220, and 230 may communicate intra-device via 248 when one or more of the mobile information handling systems 210, 220, and 230 are set to act as an access point or even potentially an WWAN connection via small cell communication on licensed or unlicensed WWAN connections. For example, one of mobile information handling systems 210, 220, and 230 may serve as a Wi-Fi hotspot in an embodiment. Concurrent wireless links to information handling systems 210, 220, and 230 may be connected via any access points including other mobile information handling systems as illustrated in FIG. 2.

Figure 3A:
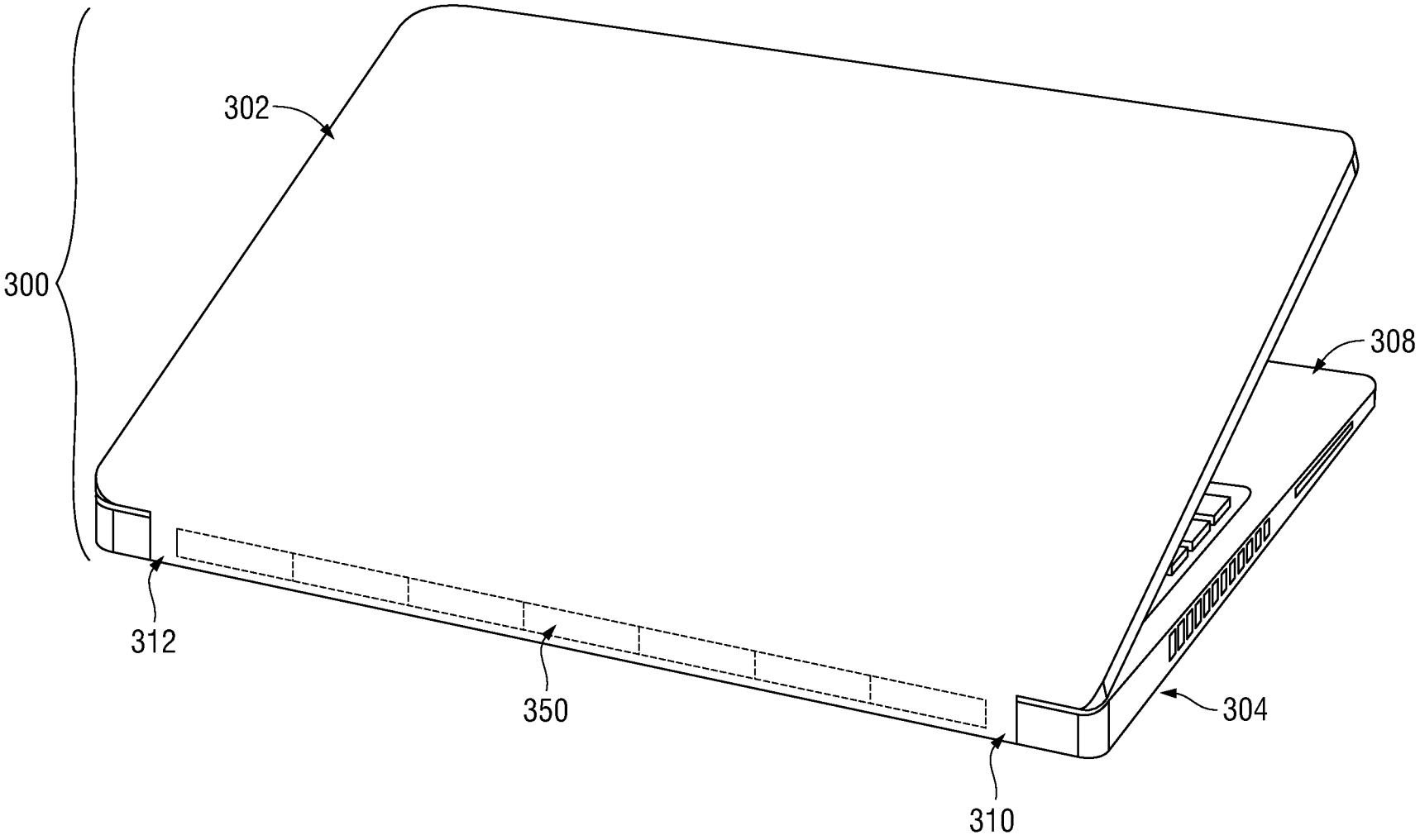
FIG. 3A is a graphical illustration of a metal chassis placed in a semi-closed configuration according to an embodiment of the present disclosure.

FIG. 3A is a graphical illustration of a metal chassis including a base chassis and display chassis placed in a semi-closed configuration according to an embodiment of the present disclosure. The semi-closed configuration is shown for illustration purposes. It is understood that a closed configuration would have the display chassis fully closed onto the base chassis. The metal chassis 300 in an embodiment may comprise an outer metal case or shell of an information handling system such as a tablet device, laptop, or other mobile information handling system. As shown in FIG. 3A, the metal chassis 300, in an embodiment, may further include a plurality of chasses or cases. For example, the metal chassis 300 may further include the A-cover 302 functioning to enclose a portion of the information handling system. As another example, the metal chassis 300, in an embodiment, may further include a D-cover 304 functioning to enclose another portion of the information handling system along with a C-cover 308 under which a transmitting/receiving antenna may be located according to embodiments described herein. The C-cover 308 may include, for example, a keyboard, a trackpad, or other input/output (I/O) device. As shown in FIG. 3A, when placed in the semi-closed configuration, the A-cover 302 forms a top outer protective shell, or a portion of a display for the information handling system, while the D-cover 304 forms a bottom outer protective shell, or a portion of a base. As also can be seen in FIG. 3A, when in the fully closed configuration, the A-cover 302 and the D-cover 304 would be substantially parallel to one another.

In an embodiment, the A-cover 302 may be movably connected to a drop hinge 312 of the A-cover 302 via one or more sides of the drop hinges 310 in the D-cover 304. The A-cover 302 may be operably connected to the hinge 312 such that a gap is disposed between the A-cover 302 and the D-cover 304, in an embodiment.

Figure 3B:
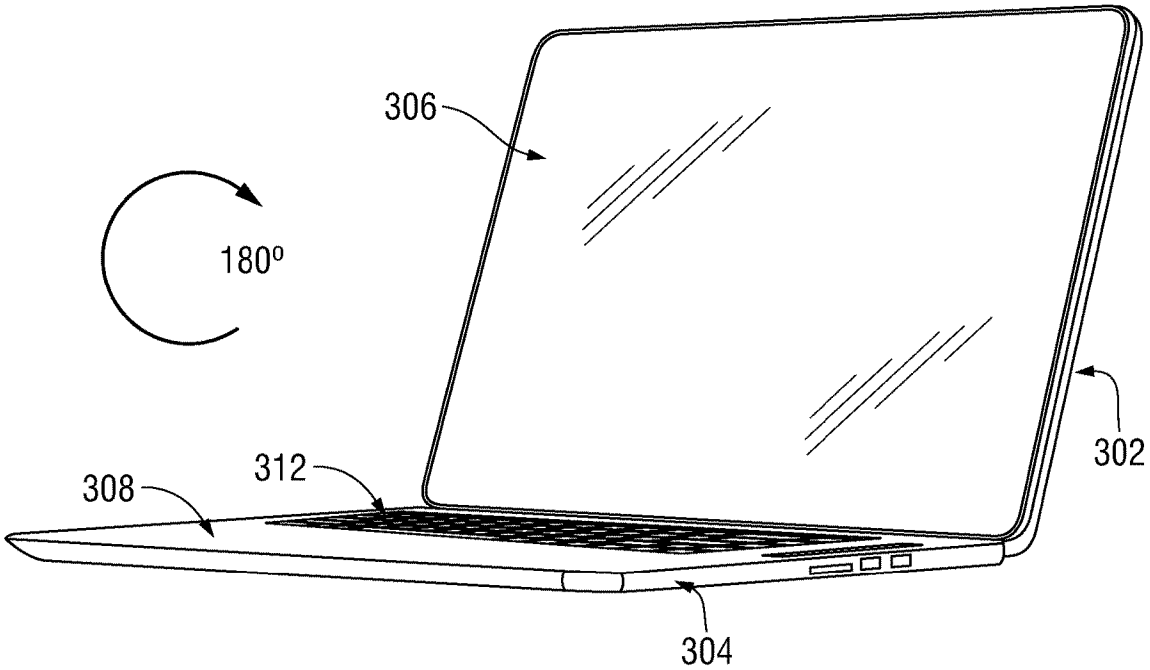
FIG. 3B is a graphical illustration of a metal chassis placed in an open configuration according to an embodiment of the present disclosure.

FIG. 3B is a graphical illustration of a metal chassis including a base chassis and display chassis placed in an open configuration according to an embodiment of the present disclosure. The metal chassis in an embodiment may further comprise an outer metal case or shell of an information handling system for housing internal components of the information handling system, such as a video display, a cursor control device, and an alpha numeric input device. As shown in FIG. 3B, the metal chassis may further include the B-cover 306 functioning to enclose the video or digital display device with the A-cover 302 described herein. As another example, the metal chassis 300 may further include the C-cover 308 functioning to enclose a cursor control device and/or a keyboard 112 acting as an alpha numeric input device. The A-cover 302 and the B-cover 306 may be joined together in an embodiment to form a fully enclosed display chassis (i.e., A-cover 302/B-cover 306 assembly), while the C-cover 308 and the D-cover 304 may be joined together to form a fully enclosed base chassis (i.e., C-cover 308/D-cover 304 assembly). Taking the closed configuration as a reference position of the display chassis including the A-cover 302 and the B-cover 306 and the base chassis including the C-cover 308 and the D-cover 304, the display chassis including the A-cover and the B-cover 306 may be rotated away from the base chassis including the C-cover 308 and the D-cover to an open configuration. For example, as shown in FIG. 3B, when placed in the open configuration, the display chassis including the A-cover and the B-cover 306 may be rotated away from the C-cover 308 and placed at an angle less than 180 degrees from the base chassis including the C-cover 308 and the D-cover, such that a user may view the digital display within the B-cover 306 and interact with the cursor control device and/or keyboard 112 within the C-cover 308.

Due to the view presented in FIG. 3B, the metal exhaust vent grill 350 is not viewable according to an embodiment. However, FIG. 3B is shown including a video display device that takes up a larger part of the surface within the C-cover 308 such that antenna placement is moved to the C-cover 308/D-cover 304 assembly. As described herein, a potential location of the antenna may be at or near the hinge 310 used to mechanically couple the A-cover 302/B-cover 306 assembly to the C-cover 308/D-cover 304 assembly along with the metal exhaust vent grill 350.

Figure 3C:
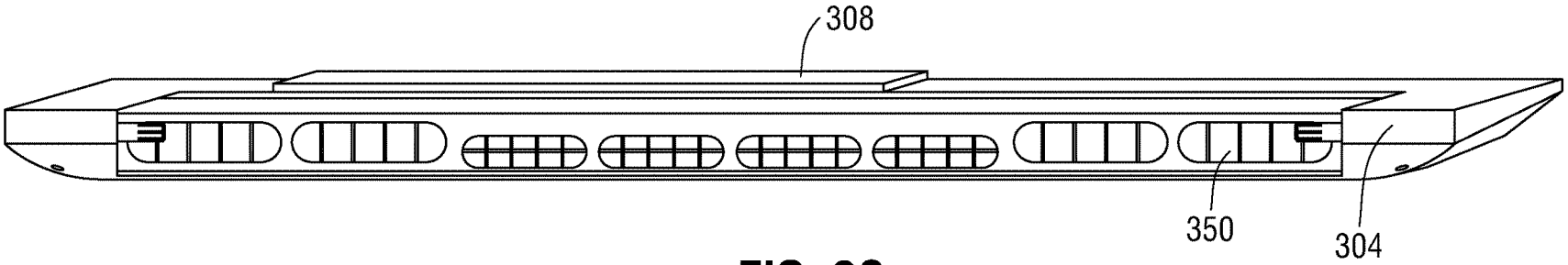
FIG. 3C is a graphical illustration of a metal chassis including a base chassis and with a display chassis removed according to an embodiment of the present disclosure.

FIG. 3C is a graphical illustration of a metal chassis including a base chassis and with a display chassis removed for ease of explanation according to an embodiment of the present disclosure. Shown is a side view of the back edge of the base chassis according to onw embodiment. With the removal of the display chassis, a back portion of the base chassis including the C-cover 308 and D-cover 304 may be seen and unblocked by the drop down hinge as shown in FIG. 3A. In the example shown in FIG. 3C, the metal exhaust vent grill 350 may be formed at a back edge of the D-cover 304. The metal exhaust vent grill 350 may open at the back edge allowing air passing by the metal exhaust vent grill 350 to exit the information handling system out the back edge. Although FIG. 3C shows that metal exhaust vent grill 350 located at a location by the back edge of the information handling system D-cover 304 near a side where a hinge may be located, the present specification contemplates that the metal exhaust vent grill 350 may be located anywhere along a back edge of D-cover 304 or along other edges of the D-cover 304.

In some embodiments, both the A-cover (not shown) and the D-cover 304 may be comprised of metal. In some embodiments, the A-cover and D-cover 304 may include both metallic and plastic components. For example, plastic components that are radio-frequency (RF) transparent may be used to form a portion of the C-cover 308 from which an upward facing antenna vent may be located. An RF transmitting antenna may be placed under the C-cover 308 in a vent cavity, such as a thermal vent cavity, in D-cover 304. That antenna may be situated in the vent cavity behind the vent grill 350. According to some embodiments of the present disclosure, the antenna vent prevents interference originating from the RF signals from the antenna interfering with the metal of the A-cover and D-cover 304 by grounding any excitation currents via the metal exhaust vent grill 350 in the D-cover 304 to the surface of the D-cover 304. The metal exhaust vent grill 350 may act as a trap to suppress any excitation currents presented by, for example, a gap within the hinge such as by metal elements within the information handling system, and any of the A-, B-, C-, and/or D-covers. The metal exhaust vent grill 350 may, therefore be used for at least two purposes: thermal venting of heat out and away from the information handling system as well as a grounding source for the antenna to ground any excitation currents to the D-cover 304 and suppress coupling to the A-cover or any hinge gap. This ground current path created at the metal exhaust vent grill 350 to the D-cover 304 allows for the redirection of excitation currents that would otherwise be emitted by the hinge gap so as to allow the antenna to be co-located near the hinge without degradation of any RF signals from the antenna. The metal vent grill 350 may trap electric field excitation in the cavity of the vent behind the vent grill 350 caused by the antenna located there. The metal vent grill 350 and antenna cavity in the D-cover 304 may then direct the radio frequency wireless signals generated via the antenna element in the vent cavity upwards through an upward-facing antenna aperture in the C-cover 308 or through the C-cover 308 depending on configuration. This, in turn, allows for the antenna or additional antennas to be placed within the information handling system and specifically at the back edge of the C-cover 308/D-cover 304 assembly. Consequently, the space within the A-cover/B-cover assembly where an antenna may have been placed may be eliminated allowing for a relatively larger video display device placed therein. As a result of placing the antenna within the C-cover 308/D-cover 304 assembly, the capabilities of information handling system may be increased while also increasing user satisfaction during use.

In an embodiment, the antenna and metal exhaust vent grill 350 may be formed at any location along the back edge of D-cover 304 near to the hinge and hinge gap. In an embodiment, the information handling system may include a plurality of antenna formed along or next to one or multiple metal exhaust vent grills 350. In this embodiment, each of the individual antennas may emit an RF signal at different frequencies allowing for the ability of the information handling system to communicate on a variety of RATs that may emit wireless signals through antenna apertures in C-cover 308.

The metal exhaust vent grill 350 may be formed so as trap any antenna-emitted EM radiation in an antenna cavity for redirection. During operation of the information handling system, the antenna may be activated and cause RF EM radiation to be emitted therefrom as well as from the aperture associated with the antenna. Because of the metal within the information handling system (i.e., the D-cover 304, the C-cover 308, the A-cover, the B-cover where present, and electrical components associated with the information handling system) certain excitation currents may be created when the RF EM radiation produced by the antenna interacts with this metal. In order to avoid this, the information handling system includes a metal exhaust vent grill 350 to form a grounding path. The metal exhaust vent grill 350 may trap or contain any electrical fields excited by the antenna ground currents in the metal parts of the information handling system thereby preventing a hinge gap or edges of the D-cover or C-cover from getting excited.

In order to effectively trap any electric fields at the metal exhaust vent grill 350, the vents formed within the metal exhaust vent grill 350 used to allow heated air to escape the information handling system may be spaced and sized to trap a specific frequency or set of frequencies that comprise the intended wireless communication band of the antenna. In an embodiment, the target frequency may be 2.4 GHz. In this embodiment, the spacing may be at least 20 mm so as to trap that 2.4 GHz target frequency within the information handling system. Any number of vents may be formed in the metal exhaust vent grill 350 such that, regardless of the target frequency to be trapped, the spacing of the vents within the metal exhaust vent grill 350 are $1/4^{th}$ of the wavelength of the target frequency. In embodiments where multiple antennas are used to transmit and receive multiple different frequencies of RF EM radiation, the metal exhaust vent grill 350 may include vents near those antennas that trap that specific frequency of electric fields created during use of those antennas. Consequently, the sizing of the vents of the metal exhaust vent grill 350 may be altered during manufacturing to trap any electric fields created by any antenna associated with the information handling system.

In an embodiment presented herein, the metal exhaust vent grill 350 may also act as ground wall for any antenna placed next to the hinge. Additionally, an antenna parasitic coupling element designed to operate at a quarter wavelength of a fundamental frequency may be used as a device to shunt ground currents to the ground wall. In these embodiments, the metal exhaust vent grill 350 may be used to help shunt currents produced by the antenna to, for example, the D-cover 304 of the information handling system. Additionally, should any additional ground paths are added to the information handling system such as a flex cable running between the D-cover 304 and A-cover 302, the ground path created by the metal exhaust vent grill 350 is not altered because the ground path to the D-cover 304 due to the ground return currents being shunted at the antenna directly to the D-cover 304. As a result of the shunting of ground currents and the trapping of the electrical fields by the metal exhaust vent grill 350, the antenna mode may be self-contained and dominant so as to provide freedom in tuning the antenna independent of any resonant cavity modes that may otherwise have been created without the metal exhaust vent grill 350.

Although FIG. 3C shows the metal exhaust vent grill 350 formed at a back edge of the information handling system, the present specification contemplates that such a metal exhaust vent grill 350 may be formed at any location on the D-cover 304 of the information handling system. In these embodiments, the metal exhaust vent grill 350 may be operatively coupled to any antenna placed at any location within the information handling system without exceeding the scope of the present disclosure.

Figure 3D:
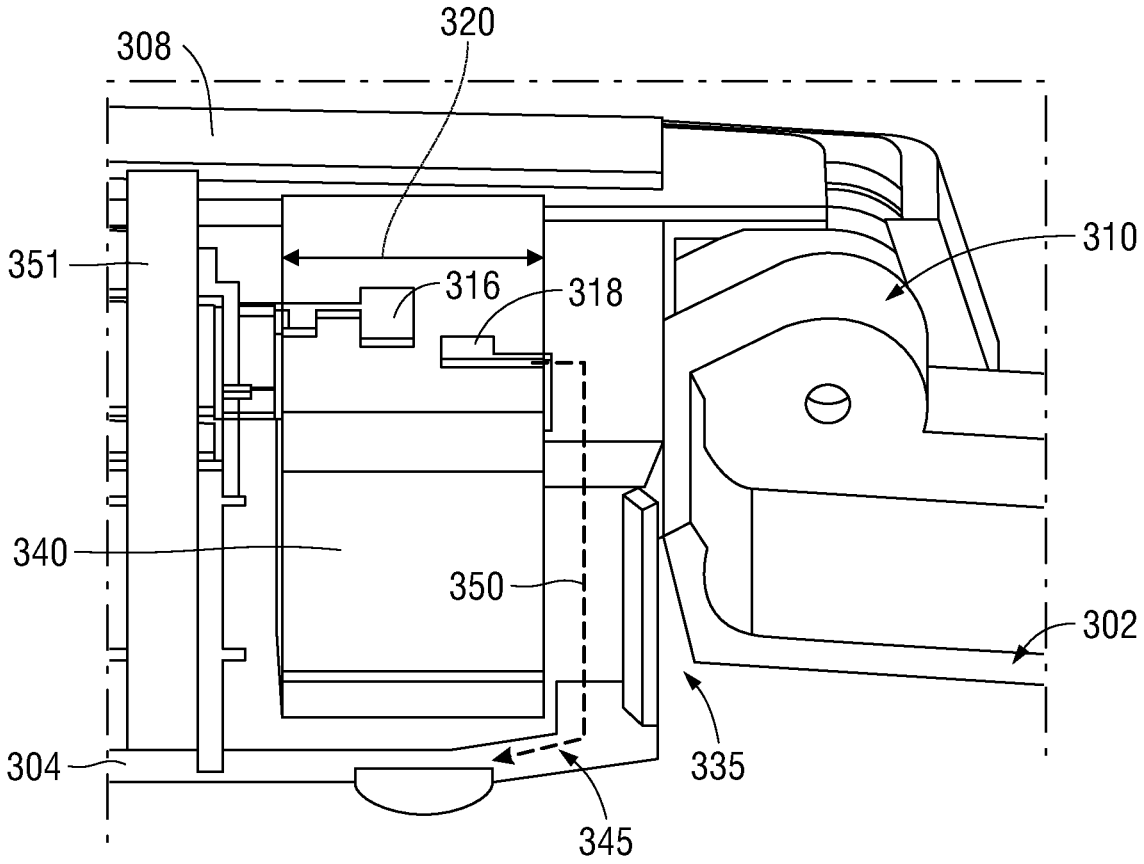
FIG. 3D side is a cut-out graphical illustration of an antenna co-located with a metal exhaust grill formed in the C-cover/D-cover assembly according to an embodiment of the present disclosure.

FIG. 3D side is a cut-out graphical illustration of an antenna 316 co-located with an exhaust vent grill 350 formed in the C-cover 308/D-cover 304 assembly according to an embodiment of the present disclosure. The antenna 316 may be physically near or within a metal exhaust vent grill 350 opening to the back edge of the D-cover 304. The antenna 316 may be electrically activated using any amount of current and voltage in order to achieve the emission of RF signals from the antenna 316. In an embodiment, the antenna 316 may be excited to emit a 2.4 GHz signal. In an embodiment, the antenna 316 may be excited to emit a 5 GHz signal. In an embodiment, the antenna 316 may be excited using a 50-ohm electrical impedance-source. Other frequencies may be emitted by the antenna 316 and the present specification contemplates such emissions of the antenna 316.

The antenna 316 may be co-located with an exhaust vent grill 350 and placed next to an exhaust vent cavity 340. Exhaust vent cavity 340 includes the metal exhaust vent grill 350 which is placed near the antenna 316 formed at a back edge of the information handling system as shown in FIG. 3D. The exhaust vent grill 350 may be made of any type of metal that provides, at least, electrical conductivity of the exhaust vent grill 350. In an example, the metal exhaust grill 350 may be made of aluminum or copper or of another conductive material. As described herein, the metal exhaust vent grill 350 may receive thermal energy from other elements and devices from within the information handling system. These other elements and devices may include any processors, graphical processors, printed circuit boards (PCBs), motors, or any other heat-emitting elements or devices. The information handling system may further include a fan (not shown) used to blow air over these elements and devices and towards the metal exhaust vent cavity 340. Due to the thermal-conductive properties of the metal exhaust vent grill 350, the metal exhaust vent grill 350 may also dissipate heat out of and away from the information handling system and the exhaust vent cavity 340.

In addition to the metal exhaust vent grill 350 and exhaust vent cavity 340 helping to regulate a temperature from within the information handling system, the metal exhaust vent grill 350 may further be electrically conductive. According to an embodiment of the present specification, the metal exhaust vent grill 350 may be used to trap excitation currents within the exhaust vent cavity 340. A ground current path 345 (indicated by a dashed line in FIG. 3D) may then be created via the parasitic element 318 designed to operate at a quarter wavelength to a fundamental frequency (i.e., 2.4 GHz). This ground current path 345 created by the parasitic element 318 may also be used as a path to shunt excitation currents to the exhaust grill electrically coupled to the D-cover 304 of the base metal chassis. This ground current path 345 mitigates currents associated with the antenna 316 from traveling to an A-cover 302 and hinge 310 of the information handling system and, instead, shunting any ground currents experienced at the metal exhaust vent grill 350 from the excitation of the antenna 316 to the D-cover 304. This prevents ground currents created by the antenna 316 from travelling to the hinge 310 and exciting a hinge gap 335 formed by, within, or near the hinge 310 or along a gap with the edge of A-cover 302.

The ground current path 345 across the metal exhaust vent grill 350 may include other elements in addition to the metal exhaust vent grill 350 to form a ground path 345 to the base chassis D-cover 302. In an embodiment, the ground current path 345 may include a ground return trap 318 formed as a parasitic element within the exhaust vent cavity 340. This ground return trap 318 may be made of any type of metal and may be electrically coupled to the metal exhaust vent grill 350 so as to receive any ground currents to the metal exhaust vent grill 350. As a result, the frequency of the electromagnetic (EM) waves emitted by the antenna 316 may be contained and remain dominant within the exhaust vent cavity 340 thereby providing for the ability of the antenna 316 to be tuned independent of any other RF waves potentially emitted from the hinge gap 335 or along A-cover 302. Thus, EM waves emitted by antenna element 316 may resonate in the exhaust vent cavity 340 and focus direction out of aperture 320 towards the C-cover 308.

The ground current path 345 may further include any shunting line that is electrically coupled to the D-cover 304. This may allow the shunting of any ground currents experienced at the metal exhaust vent grill 350 from the excitation of the antenna 316 to the D-cover 304. This shunting line may be made of an electrically conductive material. As the current reaches the D-cover 304, the D-cover 304 may dissipate the charge over the entirety of the surface so the D-cover 304 grounds surface currents and limited resonance occurs to the A-cover 302.

In an embodiment, the antenna 316 may be operatively coupled with an aperture 320. As described herein, an antenna 316 may be tuned for improved wireless antennas employed in information handling systems of the present disclosure. In an embodiment, an aperture or slot 320 may be co-located with the antenna 316 and the exhaust vent grill 350. An aperture associated with the antenna 316 in embodiments of the present disclosure may be directed toward the C-cover 308 and cause the edges of the aperture to act as an RF excitable structure. Such a method of placing an aperture associated with the antenna 316 at a location below C-cover 308 may exclude the integration of any RF transparent plastic windows within the exterior of the A-cover or the D-cover, thus decreasing the complexity and cost of manufacture. The directionality of the aperture 320 without conflicting resonance due to the electric field trap of the metal exhaust vent grill 350 is improved in an upward direction when an information handling system is in an open configuration.

In an embodiment, the antenna 316 may be associated with an additional parasitic coupling element (not shown). In this embodiment, the additional parasitic coupling element may be used to change the directionality and/or pattern of the emitted RF signals from the antenna. In an embodiment, the parasitic coupling element may also be used to alter the mode or RF frequency range of the antenna 316.

Figure 3E:
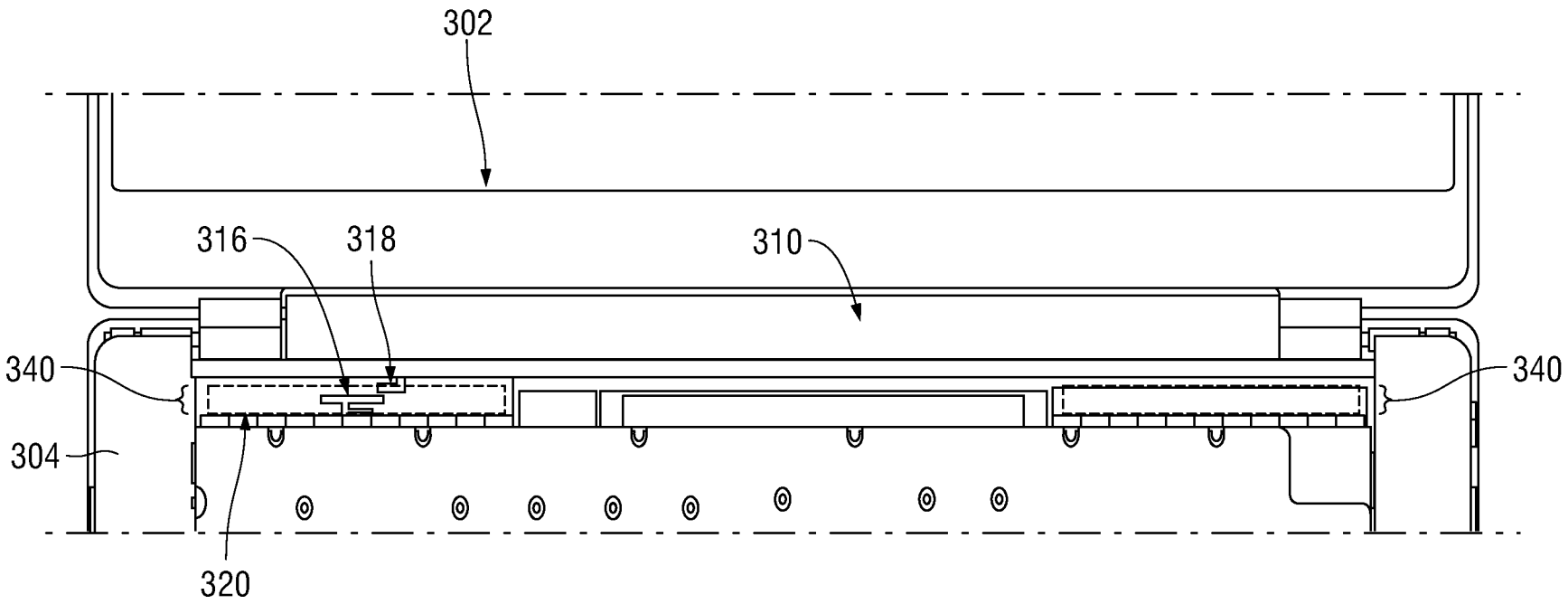
FIG. 3E is a top graphical illustration of an antenna co-located with an exhaust vent cavity formed in the D-cover according to an embodiment of the present disclosure.

FIG. 3E is a top view graphical illustration of an antenna 316 co-located with an exhaust vent cavity 340 formed in the D-cover 304 according to an embodiment of the present disclosure. D-cover 304 is shown without a C-cover to reveal detail inside the vent cavity that serves as an antenna cavity along the back edge of D-cover 304 according to an embodiment. FIG. 3E shows that antenna 316 formed in a back edge of the D-cover 304 where the exhaust vent cavity 340 may exhaust heat from the base chassis. The ground return trap may begin with the parasitic element and the metal exhaust vent grill (not shown) located at the back edge of the D-cover 304. The ground current path may pass between the parasitic element 318 to the metal exhaust vent grill 350 and to the D-cover 304 as described herein mitigating currents at hinge 310, hinge gap 335, or A-cover 302. An aperture 320 (shown by a dotted line in FIG. 3E) may be placed above the antenna and covering a portion of the exhaust vent cavity 340. The aperture 320 may be used to direct the emitted RF EM radiation from the antenna 316 upwards and out of the C-cover 308 when the information handling system is in an open configuration. In some embodiments, a front grounding wall 351 may be placed in front of the antenna 316 to isolate the antenna radiated noise and prevent that noise from coupling into the C-cover 308 such as with a keyboard formed on the C-cover 308, or any other portion of the base chassis between the C-cover 308 and D-cover 304 of the information handling system. In this embodiment, the antenna 316 has a grounding wall 351 in a front portion of the exhaust vent area to shield the keyboard from the RF excitation currents of the antenna 316 while a back grounding wall may be placed behind the antenna 316 implementing a metal exhaust vent grill 350 to prevent radiated noise getting coupled to the A-cover 302 electronics through the hinge cavity, thereby enhancing the wireless performance.

According to an embodiment, the information handling system may include a plurality of exhaust vent grills 350. Although not shown in FIG. 3E, any additional metal exhaust vent cavity 340 may also include an antenna 316 and ground current path 345 with its ground return trap 318 and metal exhaust grill. Each of these antennas 316 may be controlled by a wireless interface adapter or other type of processing device to emit a separate and distinct RF signal therefrom. Accordingly, the information handling system may be tuned to operate across multiple frequencies concurrently thereby increasing the communication abilities of the information handling system. This increase in communicative abilities of the information handling system thereby increasing the functionality of the information handling system and increasing user satisfaction.

Figure 4:
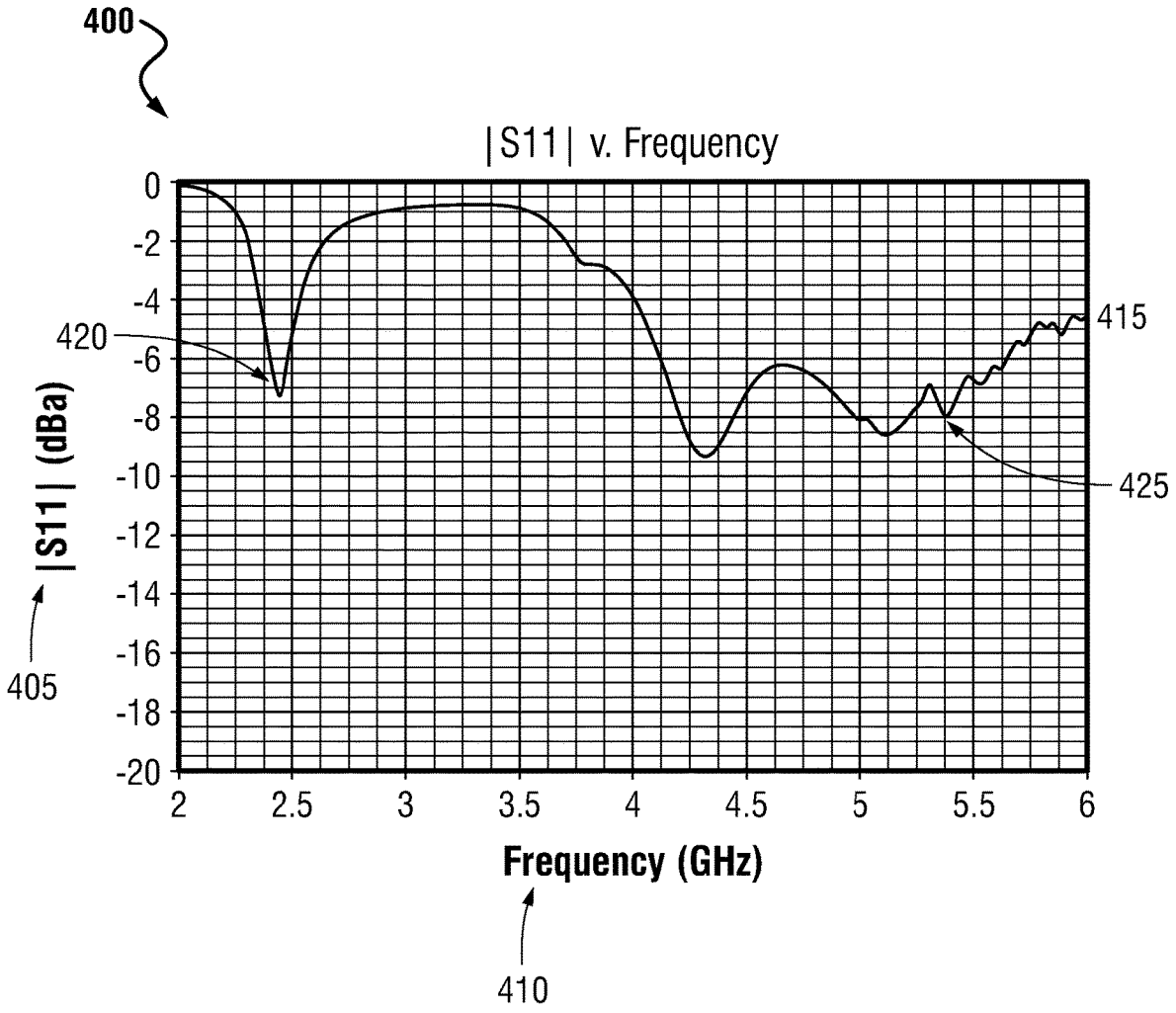
FIG. 4 a graph showing values of return loss (in dBa) versus frequency of a RF wave according to an embodiment of the present disclosure.

FIG. 4 is a graph 400 showing values of return loss (in dBa) 405 versus frequency 410 of an RF wave according to an embodiment of the present disclosure. Graph 400 shows the return loss versus a frequency and may be measured using a vector network analyzer (VNA) that plots return loss values relative to frequency. The graph 400 has a single line 415 that describes the return loss of the signal versus the frequency with and without portions of the antenna system. Plotted line 415 shows the return loss of the signal versus the frequency when the metal exhaust grill is used within the information handling system as described herein. As shown in graph 400, the return loss 405 (i.e., loss of power in a signal returned or reflected after transmission by the antenna) shows an increase in return loss along plotted line 415. As shown in FIG. 400, the plotted line 415 indicates that at a first point 420 around 2.4 GHz and its harmonics (i.e., second point 425) at, about, 5.4 GHz the signal has less power loss due to the use of the metal exhaust vent grill 350 described herein. In this case, the vents within the metal exhaust vent grill 350 are formed to trap or contain any electrical fields excited by the antenna ground currents in the metal parts of the information handling system thereby preventing a cavity within the hinge from getting excited.

Figure 5:
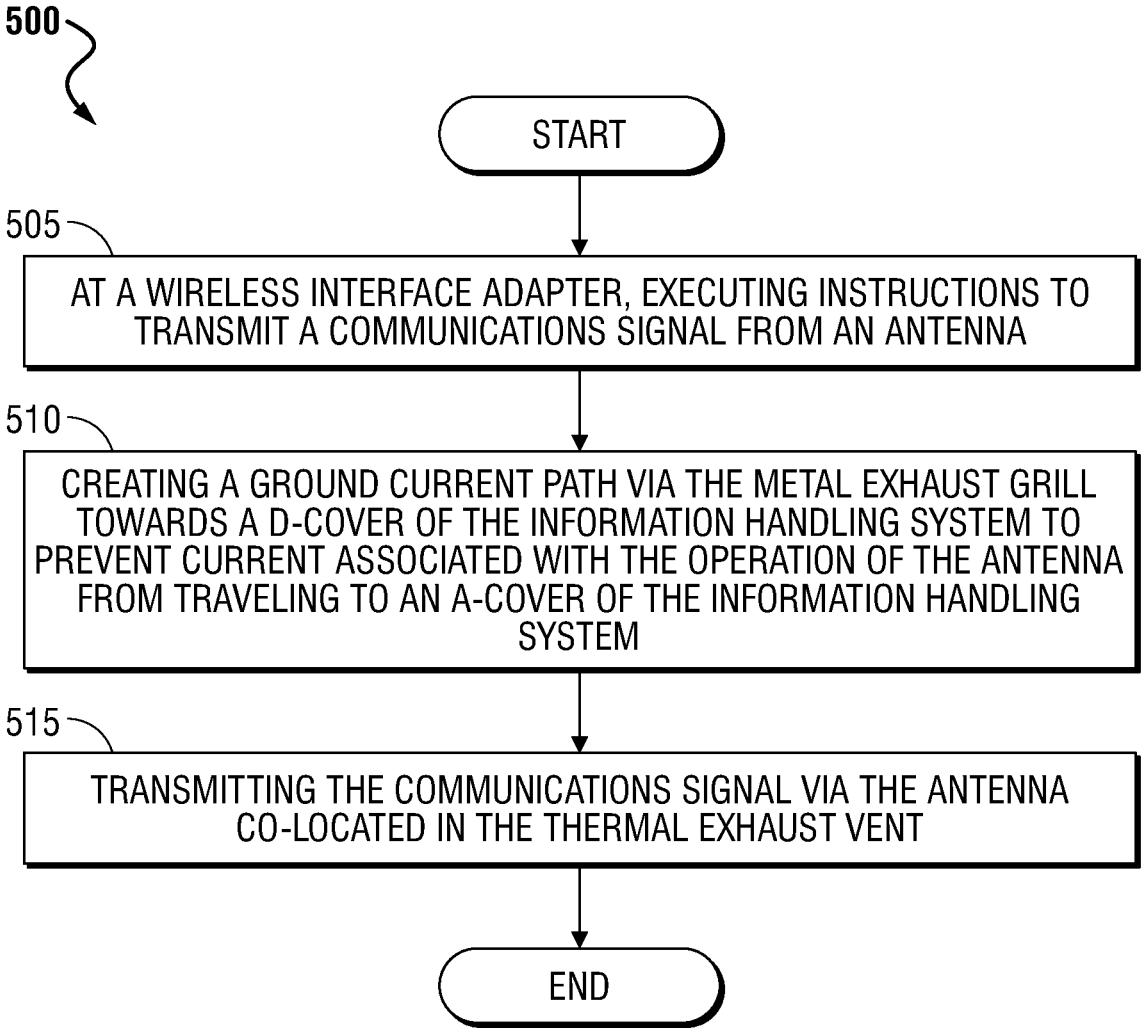
FIG. 5 is a flow diagram illustrating a method for operating an information handling system having an antenna co-located with a metal exhaust grill according to an embodiment of the present disclosure.

FIG. 5 is a flow diagram illustrating a method 500 for operating an information handling system having an antenna vent co-located with a thermal vent or audio vent according to an embodiment of the present disclosure. The method 500 may include, at block 505, executing instructions to transmit a communications signal from an antenna at a wireless interface adapter. In an embodiment, these instructions may be executed by the processor of the information handling system. In an embodiment, these instructions may be executed by an antenna adaption controller associated with the wireless interface adapter. In an embodiment, the execution of these instructions may be completed partially by the processor of the information handling system and antenna adaption controller. In either example, the execution of the instructions causes a voltage at a certain current or currents to be applied to an antenna such as a monopole antenna placed within an antenna vent. As described herein, the signals sent to the antenna may causes electromagnetic waves in any range or a target range of a RF on the EM spectrum.

At block 510, during operation of the antenna in the method 500 a ground current path is formed via the metal exhaust grill towards a D-cover of the information handling system to prevent current associated with the operation of the antenna from traveling to an A-cover of the information handling system. As described herein, the ground current path and metal exhaust grill shunts any ground currents experienced at the metal exhaust grill from escaping the vent cavity for excitation of the hinge, hinge gap, or A-cover. This prevents ground currents created by the antenna from travelling to the hinge and exciting a cavity formed by, within, or near the hinge or A-cover. This allows the currents to bypass a hinge gap formed by the hinge, A-cover and D-cover, thereby preventing any resonance from originating from the hinge gap.

At block 515, the communications signal may be transmitted by the antenna. As described herein, the antenna may be co-located in a thermal exhaust vent with a metal exhaust grill coupled to a grounding parasitic element. The specific arrangement of the antenna relative to the metal exhaust grill allows formation of an electric field trap in the cavity formed with the exhaust vent grill such that any excitation currents to be shunted through the metal exhaust grill, and its ground current path to the D-cover. In some embodiments, a front grounding wall may be placed in front of the antenna along the exhaust vent portion to isolate the antenna radiated noise and prevent that noise from coupling into the C-cover, such as a keyboard formed on the C-cover, or any other portion internal to the base chassis between the C-cover and D-cover of the information handling system. In this embodiment, the antenna has a grounding wall in front along the space occupied by the antenna to shield the keyboard or other components internal to the base chassis from the RF excitation currents of the antenna while a back grounding wall may be placed behind the antenna implementing a metal exhaust vent grill to prevent radiated noise getting coupled to the A-cover electronics through the hinge cavity, thereby enhancing the wireless performance. This specific arrangement of the antenna and at least two ground walls formed, one behind the antenna using metal exhaust grill and one in front to shield the rest of the base chassis allows formation of an electric field trap in the cavity formed with the exhaust vent grill. As described, the ground wall formed in front of antenna, shields the antenna radiated noise from propagating into the keyboard and rest of motherboard electronics in the base chassis of the information handling system. In yet other embodiments, additional ground walls may be utilized to establish an antenna cavity within the exhaust vent to provide even more substantial isolation of the antenna and a more complete electric field trap around the transcieving antenna.

At block 515, the antenna element, thermal vent cavity, and grounding wall shielding the keyboard and internal electronics of the base chassis cooperate to resonate the aperture placed above the antenna to direct transmission primarily from the antenna aperture through the C-cover. As stated, it is contemplated that additional ground walls may further establish the e-field trap in other embodiments in addition to the thermal vent exhaust grill and front grounding shield wall. This upward directionality improves both the transmission and reception with base station systems, for example such as those above the horizon. Additionally, the trap formed by the exhaust vent grill 350 improves the transmission and reception properties of the antenna and aperture by reducing signal loss due to any resonance beyond the antenna cavity except through the antenna aperture upwards through the C-cover.

Figure 6:
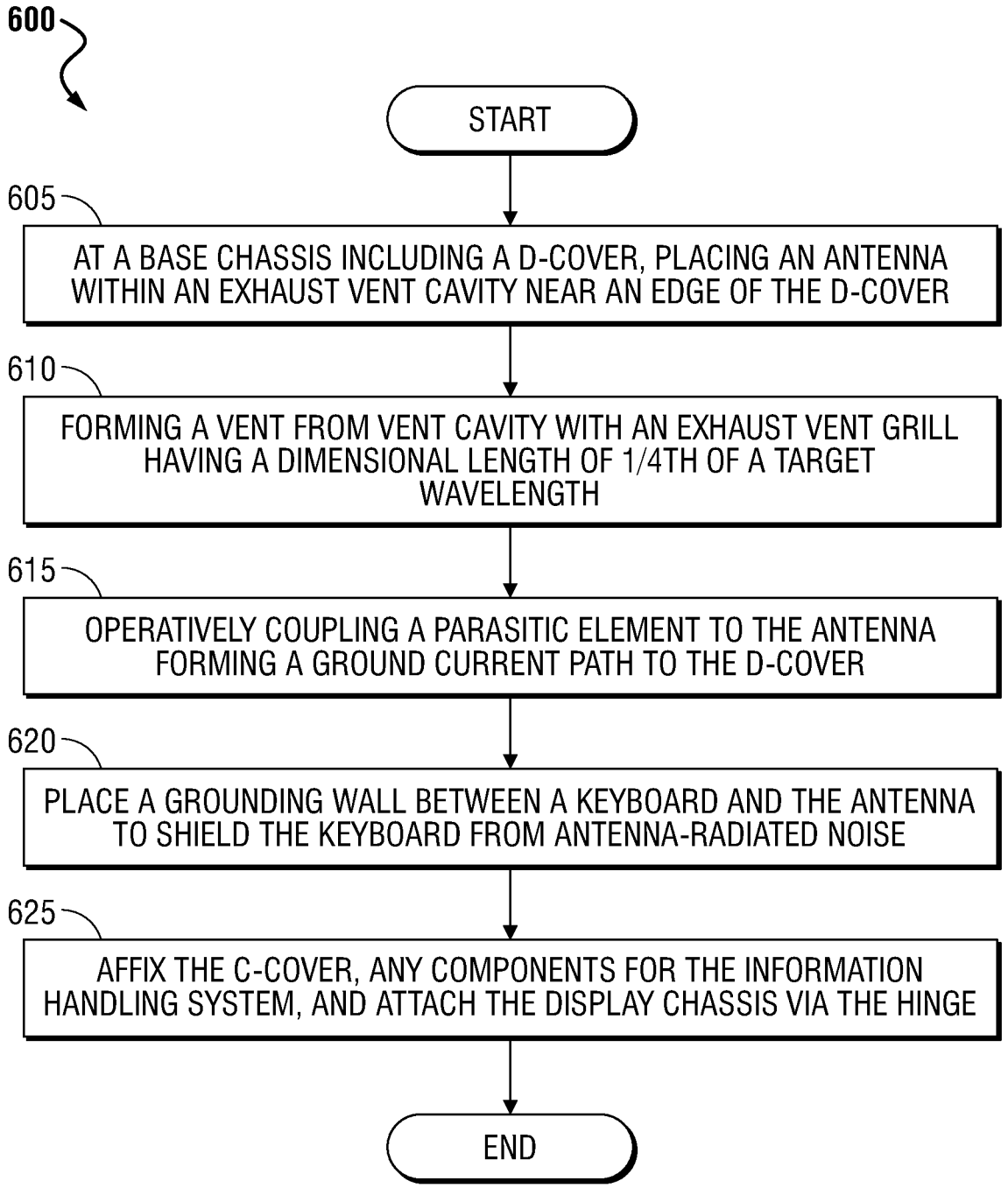
FIG. 6 is a flow diagram illustrating a method of manufacturing an information handling system according to an embodiment of the present disclosure.

FIG. 6 is a flow diagram illustrating a method 600 of manufacturing an information handling system according to an embodiment of the present disclosure. The method 600 may begin at 605 with, at a base chassis including a D-cover, placing an antenna element within an exhaust vent cavity near an edge of the D-cover. It is understood that the exhaust vent cavity may be near any edge of the D-cover and may be co-located with a thermal vent or other vent cavity, such as an audio vent cavity. In the currently described embodiment, the antenna is placed within a thermal vent cavity located along a back edge of the D-cover. The antenna element may be a printed antenna element and may be connected via a wire or printed conductor to radio front end circuitry of a wireless interface adapter as described in embodiments herein. The radio front end circuitry of the wireless interface adapter may coordinate with any antenna adaptation controller and other radio frequency subsystems such as a WLAN or WWAN module for various wireless protocols to generate communication radio frequency signals via the antenna element and related structures of the embodiments herein.

The method 600 may continue at 610 with forming a vent in an edge of the D-cover to the vent cavity within the C-cover and D-cover assembly of the base chassis. The vent formed in the D-cover may then include forming an exhaust vent grill over the vent opening. In an embodiment the vent opening, with the exhaust vent grill may allow warm air to escape the base chassis in the case that the antenna element is place in a thermal exhaust vent cavity for example. The exhaust vent grill may be formed of slats of metal or other conductive material formed across the vent opening in the edge of the D-cover. In an example embodiment, the exhaust vent grill may be formed by machining through the metal D-cover edge. In other embodiments, a vent opening may have a metal exhaust vent grill attached after formation to provide for air exhaust while still providing an electric field trap according to embodiments herein. The vent openings of the metal exhaust vent grill may be specifically sized pursuant to containing a target frequency or RF EM radiation that is to be emitted by the antenna element and its aperture to within the thermal vent cavity, or other vent cavity such as an audio vent cavity, that is also to serve as an antenna cavity. In an embodiment, a dimension of the vent opening or vent openings within the exhaust vent grill may include a length of $\frac{1}{4}^{th}$ of the target wavelength to be transmitted or received by the antenna element within the vent cavity. This chosen length prevents the RF EM radiation from escaping the vent cavity and forms an electric field trap at the exhaust vent grill while allowing air or soundwaves to escape. In an embodiment, this exhaust vent grill is made of a metal that is electrically conductive to trap excitation currents within the exhaust vent cavity formed to house the exhaust vent grill. Additionally, the exhaust vent grill may be thermally conductive such that heated air flowing past the exhaust vent grill may help to dissipate heat from within the information handling system to an exterior of the information handling system in an embodiment where the vent cavity is a thermal exhaust vent cavity. Consequently, the exhaust vent metal grill acts as a trap to contain the electric fields excited by the antenna ground currents in the base chassis thereby reducing excitation at any metal edges or gaps such as a gap at the hinge between the A-cover and the D-cover. This arrangement of the exhaust vent grill also allows a mode of the antenna to be self-contained and dominant so as to provide freedom tune the antenna independent of the cavity mode. For example, an antenna aperture may be formed in the top of the vent cavity containing the antenna element or formed in the C-cover placed over the vent cavity. The antenna aperture may direct the transmitting electromagnetic radiation field of the wireless signals upwards through the C-cover which may provide for improved wireless signaling in transmission as well as improved directional reception of wireless signals.

The method 600 may continue at 615 with operatively coupling a parasitic element in the antenna cavity to form a ground current path to the D-cover. This ground current path, as described herein, shunts any excitation currents at or around the antenna to the D-cover through the exhaust vent grill thereby reducing noise experienced by the antenna and increasing the efficiency of transmission and reception of RF EM radiation by limiting resonance outside of the intended direction of transmission. In an embodiment, a grounding wall may be placed in front of the antenna at block 620 to shield the keyboard and other motherboard components within the base chassis from being affected by antenna radiated noise and thereby also increasing the efficiency of transmission and reception of RF EM radiation by mitigating power lost in external resonance of the signal.

Proceeding to 625, the method may include affixing the C-cover over the D-cover after all components of the base chassis are installed and connectors with the display chassis have been installed. The processors, memory, graphics systems, power systems, connectors, and various other components may be installed in the base chassis in any order as understood in the art. Further, affixing the C-cover over the D-cover may include installation of any input/output devices such as keyboards, touchpads, display screens, security devices or other components along with the C-cover. In an aspect, the C-cover may include an antenna aperture located above the antenna vent cavity to permit upward transmission and reception of wireless signals with the antenna element. In other embodiments, the antenna aperture and antenna element may be below the C-cover. In various embodiments, a radiofrequency transparent material may be used to cover the antenna aperture which may let wireless signals pass but prevent dust, liquids, or other material from inadvertently entering the vent cavity from above. In another aspect, the display chassis may be attached via a hinge mechanism and include connection of one or more power or data transmission lines between the base chassis and the display chassis in an embodiment. In one example embodiment, the display chassis may comprise an A-cover/B-cover assembly and the edge of the A-cover may be hinged to the back edge of the D-cover. The hinge may be of any form in various embodiments. In a particular embodiment, a portion of the lower edge of the A-cover may include a drop barrel hinge that may be operatively coupled to hinge connection points at the sides of the back edge of the D-cover to form the hinge between the display chassis and the base chassis. With movement of the antenna system to co-locate the antenna element with a vent cavity in the base chassis, additional room may be provided for in the display chassis to accommodate a larger display system such that minimal or no bezel in the B-cover may be better achieved. Although the specific processes described in connection with FIGS. 5 and 6 are described in a specific order, the present specification contemplates that the order of these processes may be altered or eliminated without exceeding the scope of the present specification.

The blocks of flow diagram of FIGS. 5 and 6 discussed above need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An information handling system to wirelessly transmit and receive data at an antenna comprising: a base chassis containing components of the information handling system, the base chassis including a C-cover and a metal D-cover housing the components; a display chassis including an A-cover operatively coupled to the base metal chassis via a hinge; a vent cavity at an edge of the D-cover; a metal exhaust grill formed at the edge of the base metal chassis to contain the vent cavity; an antenna element co-located within the vent cavity; and a ground current path forming an electric field trap via the metal exhaust grill to the D-cover of the base metal chassis in the vent cavity to limit currents from resonating metal structures external to the vent cavity of the information handling system; and an antenna aperture to direct resonance with the antenna element out of the vent cavity.

2. The information handling system of claim 1, comprising a parasitic coupling element tied to the ground current path to further the ground path for the electric filed trap formed with the metal exhaust grill.

3. The information handling system of claim 1, wherein the ground current path bypasses a hinge gap formed between the A-cover and base metal chassis when the information handling system is placed in an open configuration to limit resonance at the hinge gap.

4. The information handling system of claim 1, wherein the dimensions of a vent opening of the metal exhaust grill is ¼th of a wavelength of a target frequency emitted by the antenna element to trap the electric fields within the vent cavity.

5. The information handling system of claim 1, wherein the metal exhaust grill is placed across a vent opening of an audio vent at a back edge of the D-cover.

6. The information handling system of claim 1, wherein the metal exhaust grill is placed across a vent opening of a thermal exhaust vent at a back edge of the D-cover.

7. The information handling system of claim 1, wherein the antenna aperture is located below a C-cover and above the antenna element to direct wireless signals through the C-cover.

8. The information handling system of claim 1, wherein the antenna aperture is located above the vent cavity further including a front ground wall to shield components internal to the base chassis from the antenna element and to direct transmission and reception out of the thermal vent cavity and upwards from the base chassis.

9. A C-cover and D-cover assembly for an information handling system comprising: a metal C-cover operatively coupled to a metal D-cover of a base chassis and including an antenna aperture and an input/output device; the metal D-cover operatively coupled to a display chassis having a display device via a hinge and the metal D-cover including: a vent cavity at an edge of the D-cover; an antenna element placed below the antenna aperture and co-located within the vent cavity to transmit a radio frequency (RF) electromagnetic (EM) wave via the antenna aperture; a metal exhaust grill at the edge across a vent opening of the vent cavity; and a ground current path forming an electric filed trap via the metal exhaust grill to the D-cover to limit currents associated with the antenna element from resonating outside the vent cavity.

10. The assembly of claim 9, comprising a parasitic coupling element tied to the ground current path to further the ground path for the electric filed trap in the vent cavity formed with the metal exhaust grill.

11. The assembly of claim 9, wherein the ground current path bypasses a hinge gap formed between the A-cover and D-cover from the vent cavity.

12. The assembly of claim 9, wherein the dimensions of a vent openings of the metal vent grill is $1/4^{th}$ of a wavelength of a target frequency emitted by the antenna element to trap the electric fields within the vent cavity.

13. The assembly of claim 9, wherein the antenna element is located within a thermal vent cavity and the metal exhaust grill allows air to escape the C-cover and D-cover assembly for thermal ventilation.

14. The assembly of claim 9, wherein the antenna element is located within an audio vent cavity.

15. The assembly of claim 9 wherein the vent cavity and the metal exhaust grill are disposed at a back edge of the D-cover along a hinge with the display chassis.

16. An information handling system to transmit a communication signal comprising:

a wireless interface adapter including an antenna adaption controller to selectively apply a current at a voltage to an antenna element, the antenna element being placed within a base metal chassis including a C-cover and D-cover and housing the components of the information handling system;

wherein the base metal chassis includes:

a metal exhaust grill formed along a back edge of the base metal chassis; and a ground current path formed via the metal exhaust grill to the D-cover of the base metal chassis to trap an electromagnetic field associated with a wireless communication signal from the antenna element within a thermal exhaust vent cavity and limit resonance with an A-cover of the information handling system operatively coupled to the base metal chassis via a hinge; and an antenna aperture disposed above the thermal exhaust vent to change a directionality or pattern of the wireless communication signal emitted from the antenna.

17. The information handling system of claim 16, wherein the ground current path bypasses a hinge formed between the A-cover and base metal chassis when the information handling system is placed in an open configuration such that the wireless communication signal is not emitted through the metal exhaust grill.

18. The information handling system of claim 16, comprising the antenna aperture to direct wireless communication signal through the C-cover.

19. The information handling system of claim 16, wherein the metal exhaust grill is formed with a plurality of vent openings having a width of $1/4^{th}$ of a wavelength of a target frequency of the wireless communication signal to trap the electric fields within the thermal exhaust vent cavity.

20. The information handling system of claim 16, wherein the antenna element co-located with the metal exhaust grill is a printed antenna element excited with a 50 ohm electrical resistance source.

* * * * *